US007967691B2

(12) United States Patent
van Remundt

(10) Patent No.: US 7,967,691 B2
(45) Date of Patent: Jun. 28, 2011

(54) SPORTS COMPLEX

(76) Inventor: Nicolaas Hyacinthus Maria van Remundt, Alphen Aan Den Rijn (NL)

( * ) Notice: Subject to any disclaimer, the term of this patent is extended or adjusted under 35 U.S.C. 154(b) by 575 days.

(21) Appl. No.: 11/995,049

(22) PCT Filed: Jul. 12, 2005

(86) PCT No.: PCT/NL2005/000500
§ 371 (c)(1),
(2), (4) Date: Jun. 3, 2008

(87) PCT Pub. No.: WO2007/008056
PCT Pub. Date: Jan. 18, 2007

(65) Prior Publication Data
US 2008/0242434 A1 Oct. 2, 2008

(51) Int. Cl.
*A63G 21/18* (2006.01)
*A63C 19/00* (2006.01)

(52) U.S. Cl. ..... 472/117; 472/92; 472/128

(58) Field of Classification Search ..... 472/88–94, 472/136, 13, 117, 128, 129
See application file for complete search history.

(56) References Cited

U.S. PATENT DOCUMENTS 6,168,532 B1 1/2001 McCaffrey
6,698,141 B2 * 3/2004 Silberman et al. ..... 52/6

FOREIGN PATENT DOCUMENTS

NL 1017102 C 7/2002

OTHER PUBLICATIONS

English Abstract of NL 1017102.

* cited by examiner

*Primary Examiner* — Kien T Nguyen
(74) *Attorney, Agent, or Firm* — Hoffmann & Baron, LLP

(57) ABSTRACT

The invention relates to a sports complex comprising: a floatable carrier body (3) with a playing field disposed thereon, a basin (4) which can be filled with liquid, in which basin (4) the carrier body (3) is situated, in which the carrier body (3) is displaceable with respect to the basin (4), and in which the basin (4) comprises a first basin part which is adjacent to a first side of the carrier body (3) and a second basin part which is adjacent to the opposite side of the carrier part, a filling means for filling the basin with liquid. The sports complex according to the invention is characterized by the fact that the sports complex furthermore comprises a liquid displacement means in order to create a difference in liquid pressure between the first basin part and the second basin part.

9 Claims, 6 Drawing Sheets

SPORTS COMPLEX

CROSS-REFERENCE TO RELATED APPLICATIONS

This application is the National Stage of International Application No. PCT/NL2005/000500, filed Jul. 12, 2005, the contents of which is incorporated by reference herein.

FIELD OF THE INVENTION

The invention relates to a sports complex.

BACKGROUND OF THE INVENTION

NL 1 017 102 describes a sports complex in which a floatable carrier body is arranged in a liquid basin. The carrier body is to a large extent made from a lightweight plastic, so that the carrier body has great buoyancy. A playing field is arranged on the carrier body, comprising turf. A liquid is introduced into the basin in order to displace the carrier body with the turf. As soon as sufficient water has been pumped into the basin to make the carrier body float, the carrier body with the turf can be taken to another position in the basin. The basin covers a surface area which is at least twice as large as the surface area of the carrier body.

A drawback of the known sports complex is the fact that displacing the carrier body in the basin leads to great resistance of the liquid. As the carrier body fits the basin relatively tightly, the liquid has to flow through the narrow space between the carrier body and the basin wall. The flow resistance in this narrow passage is high.

SUMMARY OF THE INVENTION

It is an object of the invention to provide an improved sports complex.

This object s achieved by a sports complex according to the present invention.

With the sports complex according to the present invention, proper use is made of the high flow resistance between the basin wall and the carrier body. As only little liquid can flow between carrier body and basin wall, it is possible to create a difference in liquid pressure between a first basin part, which is situated on one side of the carrier body, and a second basin part, which is situated on the opposite side of the carrier body. Due to the difference in liquid pressure between the first and second basin part, a force is exerted on the carrier body, which can be used in order to displace a carrier body in a manner similar to a piston in a hydraulic cylinder. In order to create the difference in liquid pressure between the first basin part and the second basin part, a liquid displacement means is provided in the sports complex according to the invention.

The sports complex according to the present invention furthermore has the advantage that the mechanical load of the carrier body is more favourable than with the structure known from NL 1 017 102. With the known sports complex, the carrier body was subjected to tensile load, as a result of which the lightweight plastic structure had to he provided with tensioning wires to reinforce the carrier body. As the carrier body in the sports complex according to the invention is subjected to a compressive load, such a reinforcement is no longer necessary.

In one advantageous embodiment, the carrier body is provided with a liquid passage, which connects the first basin part and the second basin part to one another. This passage may, for example, consist of a tube which is arranged in the carrier body, which is preferably made of plastic. Inside this liquid passage, the liquid displacement means is then arranged. This liquid displacement means is preferably a pump. This pump may be designed in the form of a screw, similar to those used as, for example, bow screws on ships.

In an alternative embodiment, the first and second basin parts are connected to one another by a liquid line, which is preferably located outside the basin. In this case, the liquid displacement means is arranged inside this line. In this case, the liquid displacement means is likewise preferably a pump.

In a further alternative embodiment, the sports complex also comprises a first buffer reservoir and a second buffer reservoir. The first buffer reservoir can be brought into liquid communication with the first basin part, for example by means of a liquid line. The second buffer reservoir can be brought into liquid communication with the second basin part, for example likewise by means of a line. In this embodiment, a liquid displacement means is present in at least one of the connections between the buffer reservoir and an associated basin part. By displacing the liquid of the respective buffer reservoir to the associated basin part or vice versa, a difference in pressure is created between the first basin part and the second basin part.

The sports complex according to the present invention also comprises a filling means for filling the basin. In many cases, this filling means will comprise a pump for supplying liquid to the basin. In one advantageous embodiment of the sports complex according to the invention, the liquid displacement means, which also creates the difference in liquid pressure between the first basin part and the second basin part is used for this purpose.

In a further advantageous embodiment, the basin covers a surface area which is at least twice as large as the surf ace area of the carrier body. Preferably, in this embodiment, the basin also comprises a sealing door. This sealing door has an open and a closed position, the sealing door in its closed position creating two basin spaces which are separated from one another. This has the advantage that, prior to the sports field being played on, only that part of the basin has to be pumped out in which the carrier body is located. This considerably reduces the amount of time it takes to discharge the liquid from the basin and, prior to a subsequent displacement, to fill the basin.

Below, a sports complex according to the invention will be explained in more detail with reference to the attached drawing, in which non-limiting exemplary embodiments are shown.

DETAILED DESCRIPTION OF PREFERRED EMBODIMENTS

Figure 1:
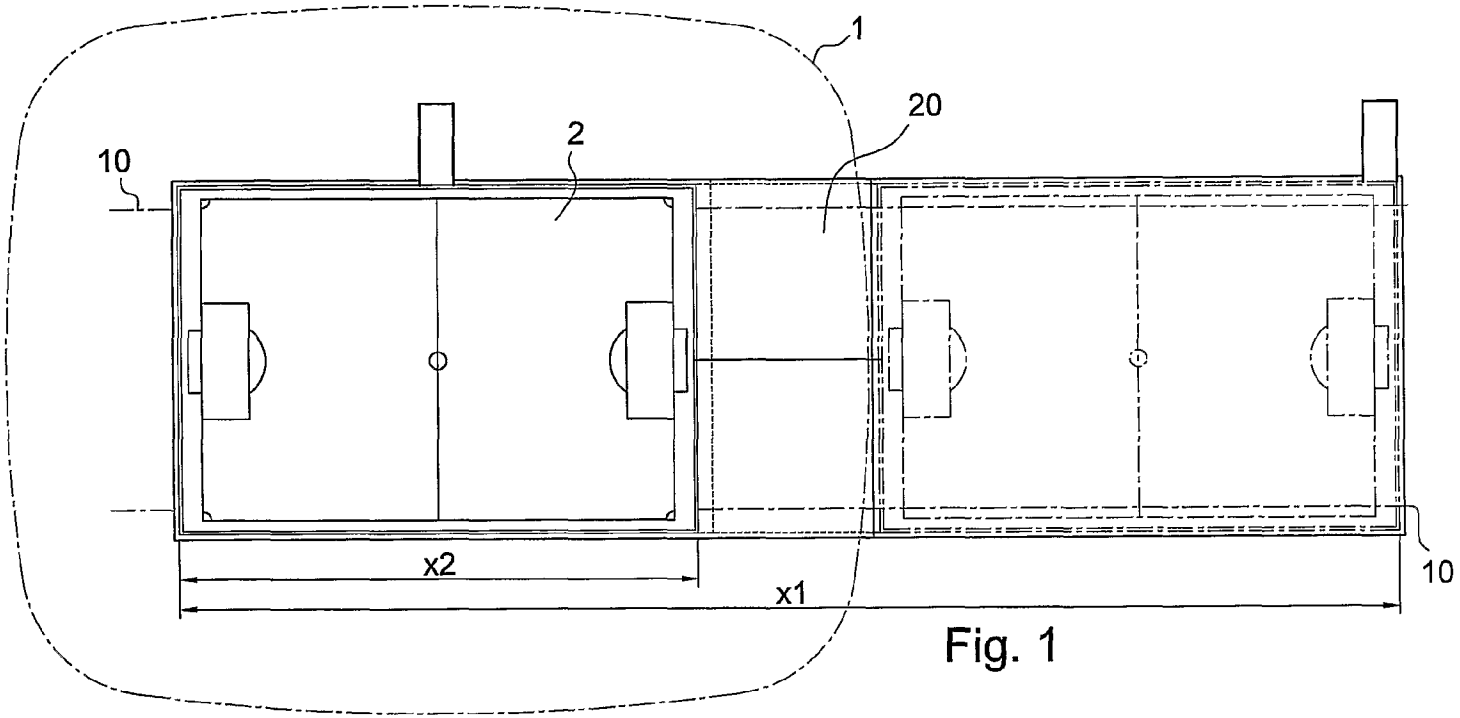
FIG. 1 shows a diagrammatic top view of a football stadium according to the invention.
Figure 2:
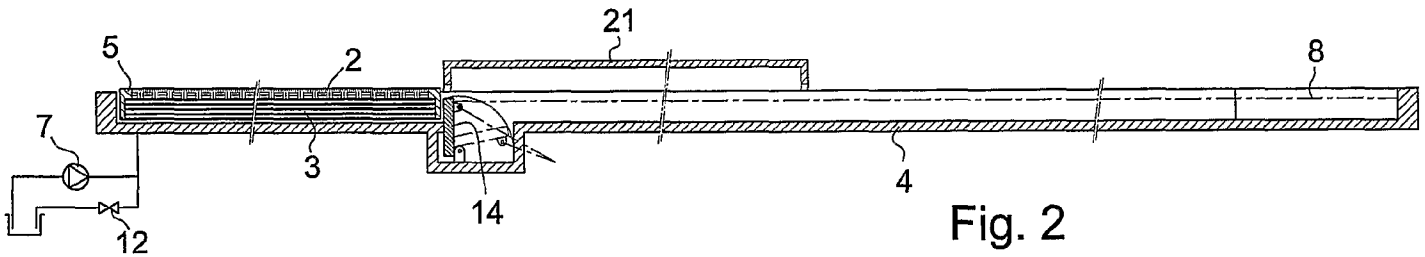
FIG. 2 shows a diagrammatic sectional view on an enlarged scale on the line II-II in FIG. 1.

FIG. 1 diagrammatically shows the outer contours of a covered football stadium by means of dash-dotted line 1. The stadium comprises stands, a playing field, etc. in the usual way. The playing field is on turf 2, which, together with a layer of soil and a drainage system, is arranged on a carrier body 3 (see FIG. 2). The carrier body 3 with turf 2 is accommodated in a basin 4. The basin 4 has a length x1 which is more than twice the length x2 of the carrier body 3. The carrier body 3 and the turf 2 are delimited at their edges by impact-resistant edge elements 5.

The carrier body 3 substantially consists entirely of polystyrene, for example tempex, or another plastic material with similar strength properties and buoyancy. The material in this case has a specific gravity of less than 100 kg/m$^3$, and in particular of less than 20 kg/m$^3$.

The basin 4 can be pumped full of liquid, for example surface water, by means of a liquid pump 7. Pumping is carried out up to a maximum filling level 8. During pumping, the carrier body 3 with turf 2 will quickly start to float. Only a small amount of water is required for this, due to the high buoyancy of the carrier body 3. Subsequently, the basin 4 can be emptied again by means of a controllable valve 12. As a result thereof, the underside of the carrier body 3 comes to rest on the bottom of the basin 4.

In the embodiment shown, the basin 4 is provided with a sealing door 14. The door 14 can be moved between an open and a closed position by means of hydraulic cylinders. In the closed position, the door 14 divides the basin 4 into two parts. This has the advantage that only that part of the basin 4 in which the playing field is situated has to be pumped out. The other part can remain filled with water, which results in a big saving in time when the playing field has to be moved again.

A central section 20 of the basin 4 is covered by a covering 21, over which the stands, etc. can be positioned.

The plastic carrier body material is preferably not hygroscopic, thus preventing it from becoming saturated with water from the basin 4 or from the wet turf 2. In one variant, the carrier body is provided with an impermeable coating.

Figure 3:
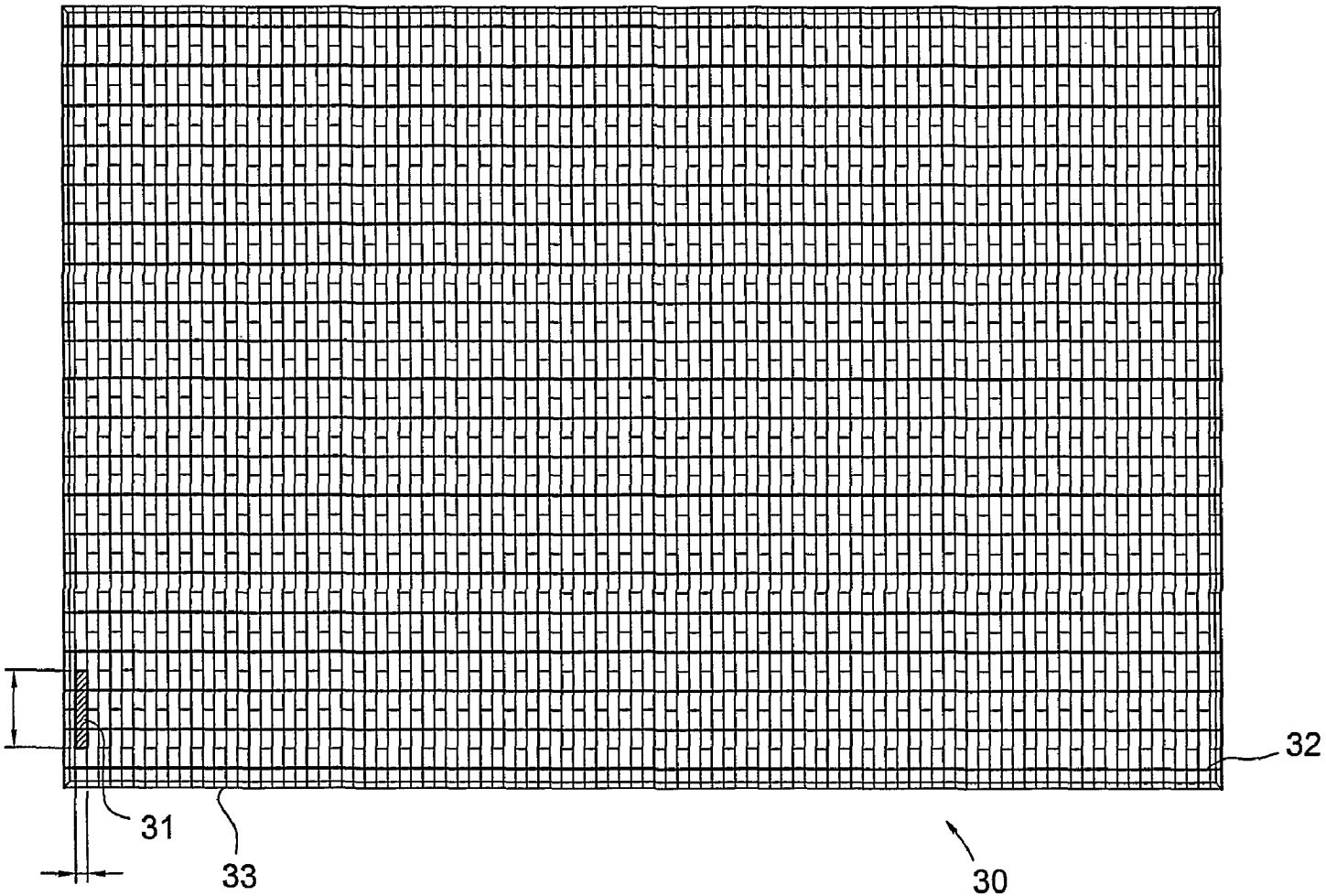
FIG. 3 shows a diagrammatic top view of an embodiment of a carrier body according to the invention.

In FIG. 3, the carrier body 30 is composed of a large number of polystyrene elements 31. The dimensions of the element 31 are, for example, 8000×1250×600 mm. This is a standard size which is commercially available. However, other dimensions are likewise possible. As can be seen, the elements 31 are connected, in particular bonded, to one another in a half-brick bond. In the longitudinal direction, tensioning wires 32 extend through the elements 31. The tensioning wires 32 can be used during manufacture to bond the elements 31 to one another under pressure. The sides of the carrier body 30 formed in this way are delimited by angle sections 33. The sections 33 are provided with a raised edge which serves to retain the layer of soil and turf to be arranged on the carrier body 30.

Many variants are possible in addition to the embodiment shown. It is conceivable to use the invention in sports stadiums other than a football stadium. The carrier body may also be produced in one piece instead of from elements connected to one another. The carrier body can be produced in situ in a relatively simple manner. Polystyrene, for example, can be foamed in situ to form structures of the desired dimensions relatively easily and accurately. In the case of large dimensions this even has the advantage with regard to fragility.

Figure 4:
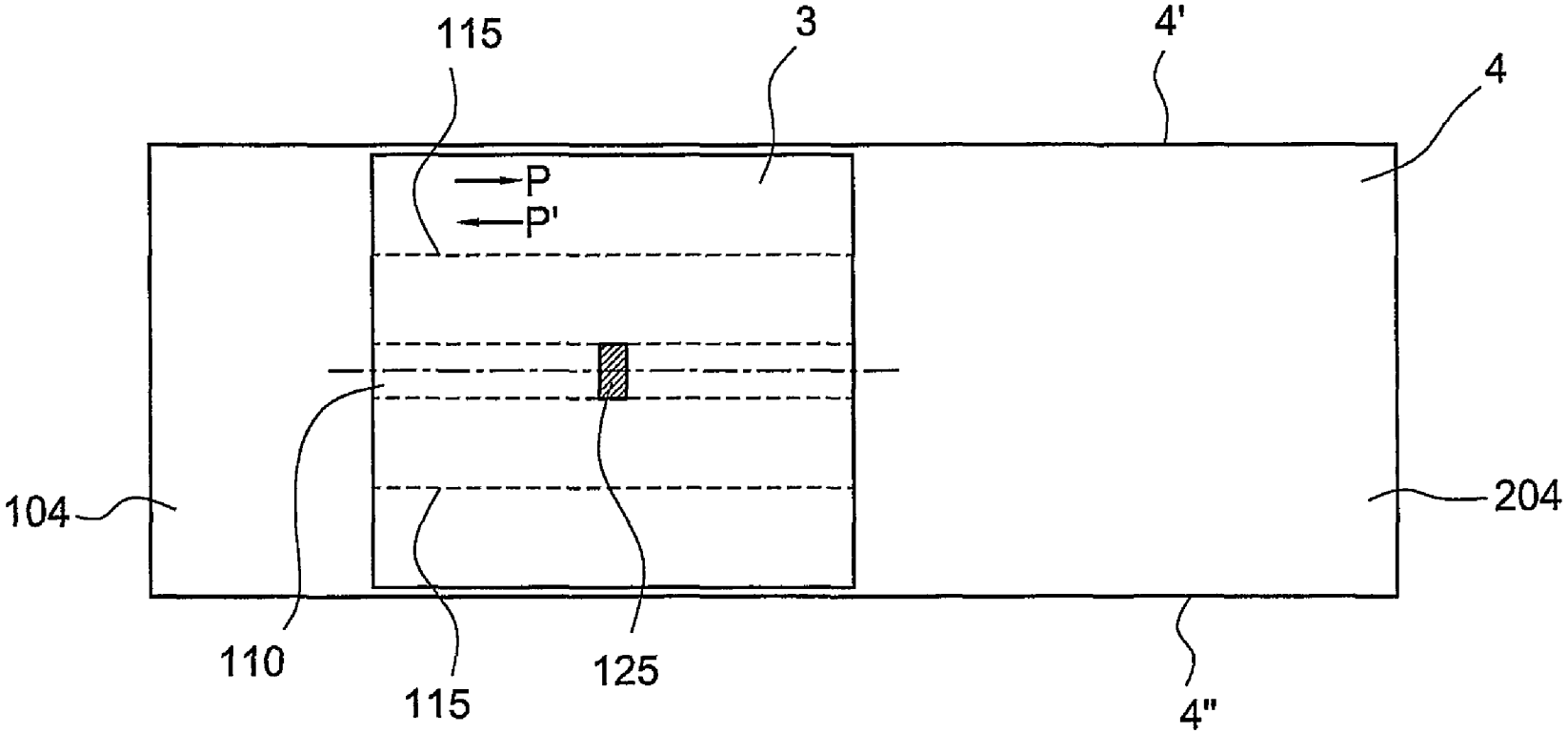
FIG. 4 shows a diagrammatic overview of an embodiment of a sports complex according to the invention.

FIG. 4 diagrammatically shows an embodiment of the sports D complex according to the invention. A floatable carrier body 3 is disposed in a basin 4 with liquid, this liquid preferably being water. In this example, the first basin part 104 is on the left-hand side of the carrier body in FIG. 4. The second basin part 204 is on the right-hand side of the carrier body 3 in FIG. 4. The carrier body 3 fits relatively accurately into the basin 4 in the width direction thereof and the basin is also relatively shallow. This offers the advantage that filling and emptying the basin requires relatively little time. As the carrier body in this example is made of a lightweight plastic, for example polystyrene, the carrier body has a great buoyancy so that the basin can be of shallow design.

As a result of this geometry, there is a high flow resistance under the carrier body and between the carrier body and the walls 4'and 4" of the basin. Due to this high flow resistance, only little liquid will flow from the first basin part 104 to the second basin D part 204 or vice versa when there is a difference in pressure between the two basin parts 104, 105. This makes it possible to maintain a differential pressure between the basin parts. This differential pressure generates a propulsive force which displaces the carrier body relative to the basin in the direction of the arrow P or P' in FIG. 4. When the carrier body is displaced, the size of the basin parts 104 and 204 thus changes.

In the embodiment of FIG. 4, a liquid passage 110 is arranged in the carrier body 3. This liquid passage contains a pump 125 which serves as a liquid displacement means. When the pump 125 pumps liquid from the second basin part 204 to the first basin part 104, the pressure in the first basin part 104 will rise and the pressure in the second basin part 204 will fall. This leads to a resultant force in the direction of the arrow P on the carrier body 3, which will be displaced in this direction P.

If required for a good circulation of the liquid, several additional passages 115, optionally provided with a pump, may be arranged in the carrier body.

The pump may be designed in the form of a bow screw, similar to those used for ships.

Figure 5:
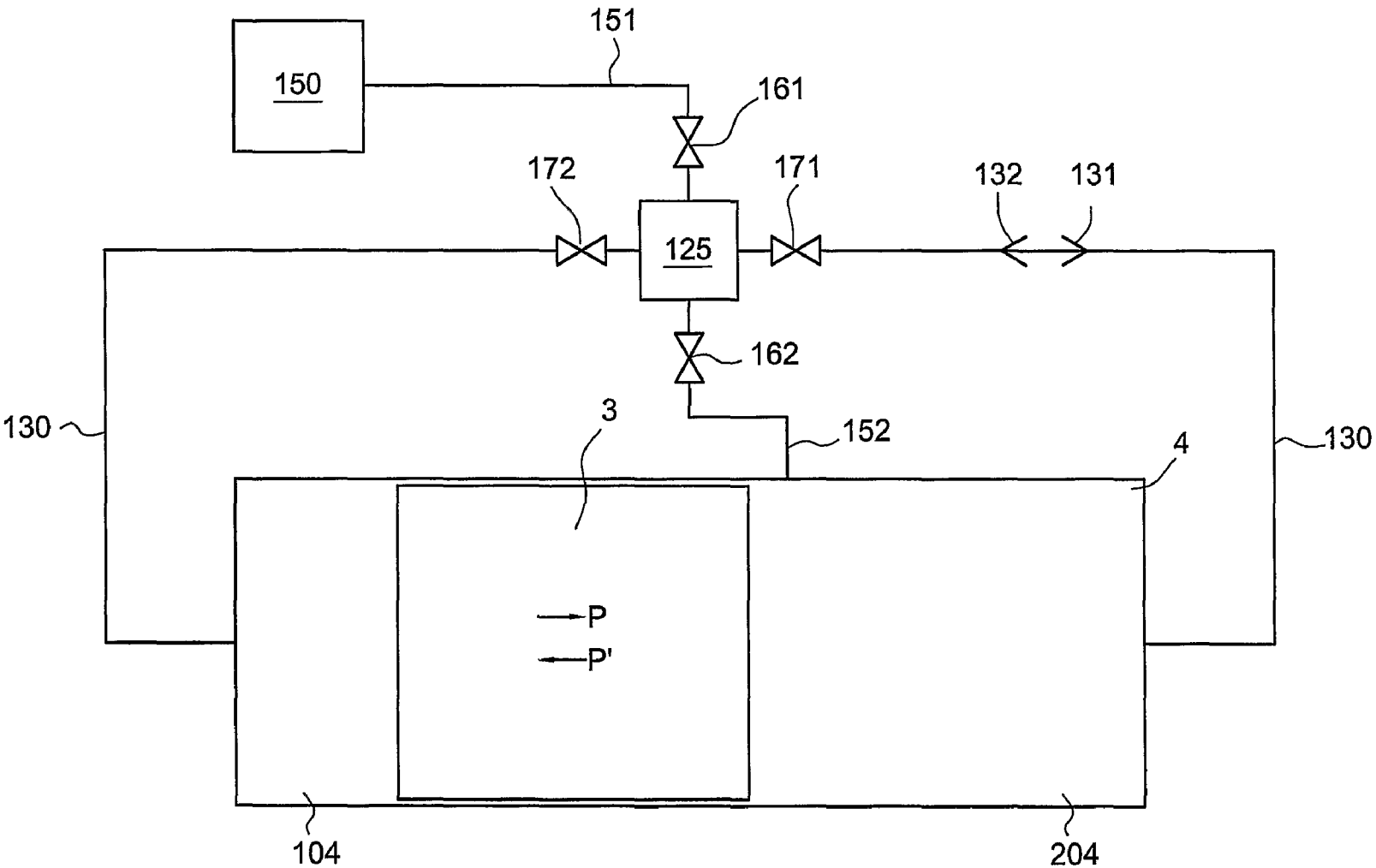
FIG. 5 shows a diagrammatic overview of an alternative embodiment of a sports complex according to the invention.

FIG. 5 diagrammatically shows an alternative embodiment of the sports complex according to the invention. In this embodiment, there is a liquid line 130 which connects the two basin parts 104, 204 to one another and a pump 125 is arranged in the line 130. In a manner similar to the embodiment in FIG. 4, this pump 125 moves liquid from the first basin part 104 to the second basin part 204 (see arrow 131) or vice versa (see arrow 132), in order to generate the differential pressure required for displacement of the carrier body 3.

In the diagrammatic illustration of FIG. 5, the filling means for filling the basin is also shown. This filling means comprises a reservoir 150 and the lines 151 and 152. In this example, the lines 151 and 152 are connected to the pump 152. By using shut-off valves 161, 162, 171, 172, the pump 125 can thus also be used for filling (and emptying) the reservoir. Of course, as an alternative, it is also possible to provide a separate pump for this purpose.

Figure 6:
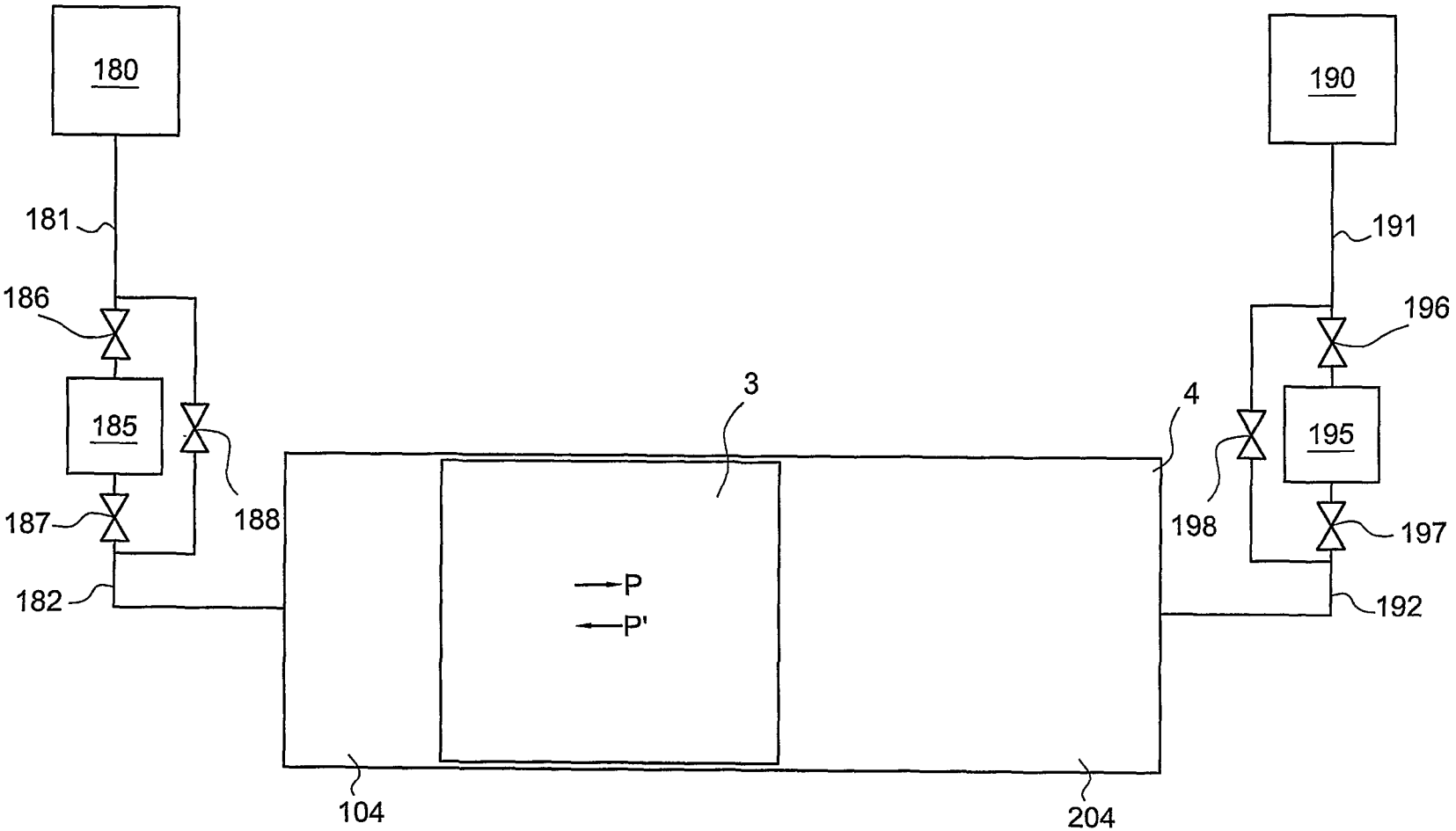
FIG. 6 shows a diagrammatic overview of a further alternative embodiment of a sports complex according to the invention.

FIG. 6 diagrammatically shows a further alternative embodiment of the sports complex according to the invention. In this embodiment, the sports complex also comprises a first buffer reservoir 180, which is connected to the first basin part 104 by means of lines 181, 182. A pump 185 is installed in the lines 181, 182. In addition, shut-off valves 186, 187 and 188 are provided and the sports complex also comprises a second buffer reservoir 190, which is connected to the second basin part 204 by means of lines 191, 192. A pump 195 is installed in the lines 191, 192. In addition, shut-off valves 196, 197 and 198 are provided. In this exemplary embodiment, the pressure in the first reservoir can be increased by energizing the pump 185 and thus pumping liquid from the first buffer reservoir to the first reservoir 104. To this end, the shut-off valves 186 and 187 are open, and 188 is closed.

By displacing the carrier body in the direction of the arrow P, liquid is forced out of the second basin part 204. As a result of the shut-off valves 197 and 196 being closed, and shut-off valve 198 being open, this liquid is supplied to the second buffer reservoir 190.

Someone skilled in the art will understand that a displacement of the carrier body 3 in the direction of the arrow P' can be achieved by reversing the situation (i.e. energizing pump 190, shut-off valves 186 and 187 closed and 188 open, shut-off valves 196 and 197 open, shut-off valve 198 closed). Alternatively, it is also possible to reduce the pressure in one of the basin parts 104, 204 in order to create the differential pressure required in order to displace the carrier body 3.

Figure 7:
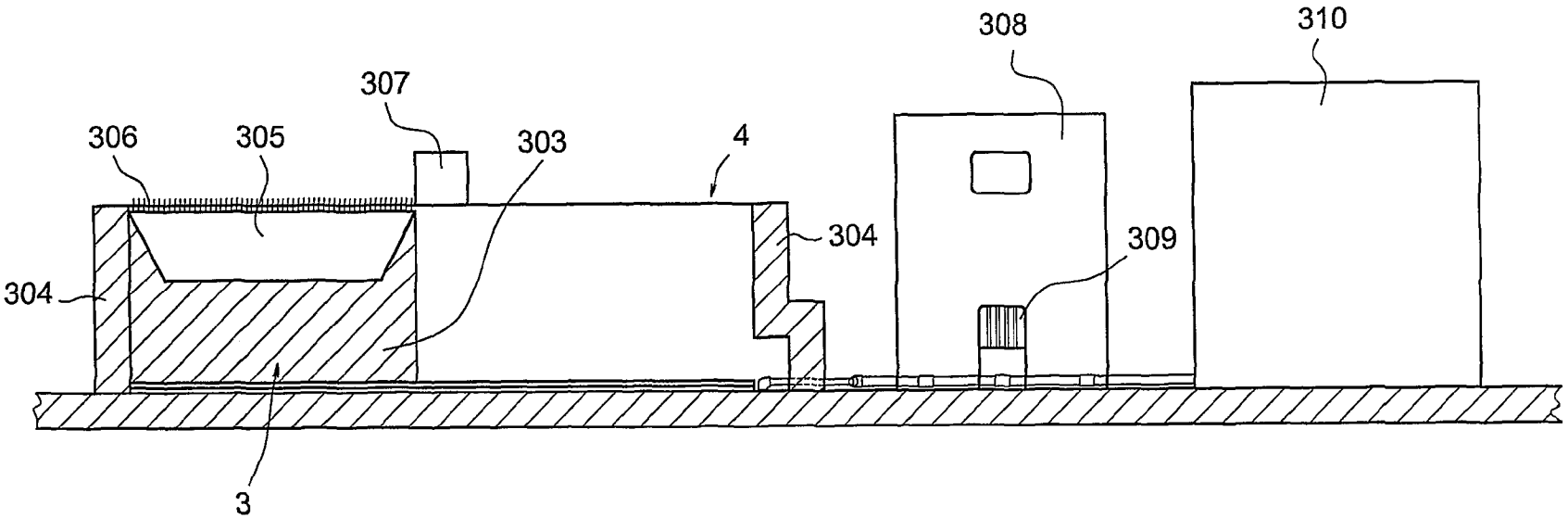
FIG. 7 shows a diagrammatic sectional view of an arrangement of a sports complex according to the invention.

FIG. 7 shows diagrammatically and in sectional view an arrangement of a sports complex according to the invention. The carrier body 3 is disposed in the basin 4. The basin has raised concrete edges 304. The carrier body comprises a polystyrene float 303 which contains soil 305 on which grass 306 for a sports field grows. A stand 307 is provided for spectators.

The various components, such as pumps and shut-off valves, are being driven by control unit 308. In this example, pump 309 is in the control cabinet.

Reservoir 310 contains a supply of surface water in order to fill the basin 4 and allow the carrier body 3 to float.

What is claimed is:

1. Sports complex comprising:

a floatable carrier body with a playing field disposed thereon, a basin which can be filled with liquid, in which basin the carrier body is situated, in which the carrier body is displaceable with respect to the basin, and in which the basin comprises a first basin part which is adjacent to a first side of the carrier body and a second basin part which is adjacent to the opposite side of the carrier part, and a filling means for filling the basin with liquid, wherein the sports complex further comprises a liquid displacement means in order to create a difference in liquid pressure between the first basin part and the second basin part, wherein the carrier body comprises a liquid passage which connects the first basin part and the second basin part to one another, in which the liquid displacement means is arranged in this liquid passage.

2. Sports complex according to claim 1, wherein the liquid displacement means is a pump.

3. Sports complex according to claim 1, wherein the basin covers a surface area which is at least twice as large as the surface area of the carrier body.

4. Sports complex according to claim 3, wherein the basin comprises a sealing door, which sealing door has an open and a closed position, in which the sealing door in its closed position creates two basin spaces which are separated from one another.

5. Sports complex comprising:

a floatable carrier body with a playing field disposed thereon, a basin which can be filled with liquid, in which basin the carrier body is situated, in which the carrier body is displaceable with respect to the basin, and in which the basin comprises a first basin part which is adjacent to a first side of the carrier body and a second basin part which is adjacent to the opposite side of the carrier part, and a filling means for filling the basin with liquid, wherein the sports complex further comprises a liquid displacement means in order to create a difference in liquid pressure between the first basin part and the second basin part, wherein the first basin part and the second basin part are connected to one another by means of a liquid line which is located outside the basin, in which the liquid displacement means is arranged in this liquid line.

6. Sports complex according to claim 5, wherein the liquid displacement means is a pump.

7. Sports complex according to claim 5, wherein the basin covers a surface area which is at least twice as large as the surface area of the carrier body.

8. Sports complex according to claim 7, wherein the basin comprises a sealing door, which sealing door has an open and a closed position, in which the sealing door in its closed position creates two basin spaces which are separated from one another.

9. Sports complex comprising:

a floatable carrier body with a playing field disposed thereon, a basin which can be filled with liquid, in which basin the carrier body is situated, in which the carrier body is displaceable with respect to the basin, and in which the basin comprises a first basin part which is adjacent to a first side of the carrier body and a second basin part which is adjacent to the opposite side of the carrier part, and a filling means for filling the basin with liquid, wherein the sports complex further comprises a liquid displacement means in order to create a difference in liquid pressure between the first basin part and the second basin part, wherein the sports complex also comprises:

a first buffer reservoir, which can be brought into liquid communication with the first basin part, and a second buffer reservoir, which can be brought into liquid communication with the second basin part, wherein a liquid displacement means is present in at least one connection between one of the buffer reservoirs and the respective basin part associated with the buffer reservoir.

* * * * *